United States Patent [19]

Storandt et al.

[11] Patent Number: 4,536,916

[45] Date of Patent: Aug. 27, 1985

[54] DOOR HOLDER-CLOSER HAVING A CONTROL SIGNAL OPERATED HOLD-OPEN FUNCTION AND A MECHANICAL OVERRIDE FACILITY

[75] Inventors: Ralf Storandt, Leonberg; Karl Mettenleiter, Weil der Stadt, both of Fed. Rep. of Germany

[73] Assignee: Geze GmbH, Fed. Rep. of Germany

[21] Appl. No.: 542,730

[22] Filed: Oct. 17, 1983

[30] Foreign Application Priority Data

Dec. 15, 1982 [DE] Fed. Rep. of Germany ..... 3246457

[51] Int. Cl.[3] ..... E05F 15/20

[52] U.S. Cl. ..... 16/48.5; 16/49; 16/71; 16/340; 16/DIG. 17

[58] Field of Search ..... 16/48.5, 49, 71, 337, 16/338, 339, 340, 342, DIG. 9, DIG. 10, DIG. 17

[56] References Cited

U.S. PATENT DOCUMENTS

| | | | |
|---|---|---|---|
| 1,585,247 | 5/1926 | Hurd | 16/49 |
| 3,935,614 | 2/1976 | Pannone et al. | 16/48.5 |
| 4,102,005 | 7/1978 | Schnarr et al. | 16/71 X |
| 4,194,264 | 3/1980 | Stoffregen | 16/52 |
| 4,287,639 | 9/1981 | Denton | 16/71 X |

FOREIGN PATENT DOCUMENTS

| | | | |
|---|---|---|---|
| 2405264 | 8/1975 | Fed. Rep. of Germany | 16/71 |
| 1091801 | 4/1955 | France | 16/48.5 |
| 2378163 | 8/1978 | France | 16/82 |

*Primary Examiner*—Fred Silverberg

[57] ABSTRACT

A door closing apparatus is described which embraces a unit for generating a closing force, a lever attached thereto via a releasable clutch for actuating the door and a controllable blocking device. The releasable clutch consists of a threaded connection which permits relative rotation between the actuating lever and the drive axle over a predetermined stroke. An abutment for frictionally locking the actuating lever is provided, with the frictional locking abutment becoming effective relative to the actuating lever at at least one end of the stroke. The holding force which sets in between the actuating lever and the frictional locking abutment is smaller than the holding force of the blocking device which blocks the unit for generating the closing force in the closing direction.

8 Claims, 3 Drawing Figures

Figure 1:
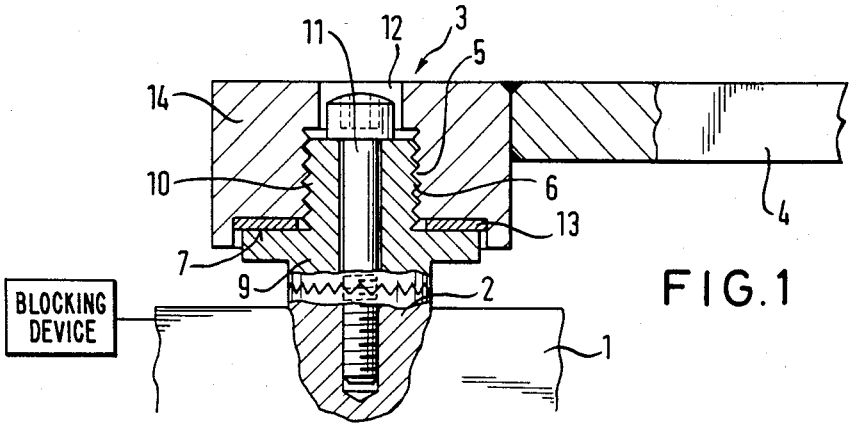

DOOR HOLDER-CLOSER HAVING A CONTROL SIGNAL OPERATED HOLD-OPEN FUNCTION AND A MECHANICAL OVERRIDE FACILITY

The invention relates to a door closing apparatus and has particular reference to a door closing apparatus of the kind comprising a closer unit for mounting on a door, and lever means extending between the unit and fixed structure surrounding the doorway. Inverse arrangements are also possible in which the closer unit is mounted on the fixed structure and the lever means is attached at one end to the door.

In one known arrangement (German Pat. No. 25 59 061) the apparatus comprises a housing for mounting on fixed structure adjacent the door, a unit for generating a closing force contained in said housing, a drive axle extending from the unit out of said housing, lever means connected between said drive axle and the door and adapted to energise the unit by rotating the drive axle on opening of the door. A blocking device is provided for blocking the unit to prevent the unit from moving the door in the door closing direction. The blocking device is capable of being switched in and/or out by control signals. Such door closing apparatus is used, amongst other things, for doors which are normally held in the open position but which are required to close automatically in the event of a fire, or at the end of the working day.

In this known arrangement the lever means comprises, in the normal way, two levers which are pivoted together, the lever nearest the housing is freely rotatably journalled on the drive axle and a cranked device is rotationally fixedly connected to the drive shaft. This cranked device is so positioned that it lies in the path of movement of the lever and is thus moved by the lever on opening the door. In this way the crank device rotates the drive axle and energises the unit for generating the closing force. The blocking device comprises a brake which acts on a drum formed on an extension of the drive axle. When the brake is operative the crank device is held stationary and the door is freely movable between the opened and the fully closed positions. When the brake is released the crank device once again contacts the closing arm and moves the closing arm in the door closing direction which, as a result of the jerky coupling between the crank and the closing arm, can lead to rebound effects.

The principal objects underlying the invention are to construct a door closing apparatus so that it is constructionally particularly simple and takes up a minimal amount of space; so that it enables a door to be held in any desired position but in such a way that the door can be freely moved, after overcoming an initial retaining force, between the selected open position and the closed position; and so that the door can always be automatically closed by release of the blocking mechanism in gentle manner without rebound effects.

In order to satisfy these objects there is provided in accordance with the present invention, a door closing apparatus comprising a housing for mounting on a door, or on fixed structure adjacent thereto; a unit for generating a closing force contained in said housing; a drive axle extending from said unit out of said housing; lever means connectable between said drive axle and the other one of said door or fixed structure and adapted to energise said unit by rotating said drive axle on opening of said door; a releasable clutch (one-way coupling) between said lever means and said drive axle; and a blocking device for blocking said unit to prevent said unit from moving said door in the door closing direction, said blocking device being capable of being switched in and/or out by control signals; wherein said releasable clutch between said lever means and said drive axle comprises a threaded connection which permits relative rotation between said lever means and said drive axle through a predeterminable angular range, and abutment means operative at at least one end of said angular range to frictionally lock said lever means to said drive axle; and wherein the frictional locking force generated by said abutment means is less than the holding force of the blocking device.

The threaded connection is preferably formed by an internal thread provided on a head part of the lever means adjacent said drive axle and by an external thread on a hub part which is rotationally fixedly connected to said drive axle.

The threaded connection, which permits the relative rotation between the lever means and the drive axle results in an extremely compact and simple construction and the use of a frictionally locked connection between adjacent surfaces of the lever means and the drive axle ensures, on the one hand, a reliable manner of operation and, on the other hand, the desired retaining effect in the region of the fully opened door. The retaining force can however be overcome without problem, if the need arises, by simply pressing the door to close, without the function of the door closing apparatus being disadvantageously affected in any way. The threaded coupling ensures gentle closing of the door independently of the instantaneous position of the door. It is constructionally of advantage to form the hub part on a connecting part having a toothed end face and to connect it in a rotationally fixed manner with a correspondingly toothed end face of the drive axle of the door closer by means of an axial securing screw. In this way assembly is made extremely simple.

The abutment means preferably comprises a ring surface provided on said connecting part and a cooperating surface on said head part.

In an alternative advantageous embodiment of the invention the abutment means comprises an annular end surface of an adjustment nut which is threaded onto said hub part, and which can be locked in a predeterminable position relative thereto, and a cooperating surface on said head part. By means of this arrangement a desired fine adjustment between the position of the drive axle and of the actuating lever can be obtained by rotating and subsequently locking the adjustment nut, independently of the tooth end face arrangement provided for coupling purposes between the drive axle and the connection part.

It is in practice particularly advantageous to arrange an adjusting disc of a specified axial thickness between the ring surface or annular end surface and the cooperating surface on said head part. By means of this adjustment disc, a fine adjustment is possible in the angular range between two sequential tooth positions of the toothed end face arrangement.

In an embodiment of the invention which is characterised in that it is suitable without any form of conversion for left and right hand abutment the abutment means comprises first and second spaced apart friction locking abutments provided for left and right hand assembly, and in that the mutual spacing between said friction locking abutments is at least somewhat larger than the length of said threaded connection required for said predeterminable angular range.

Figure 2:
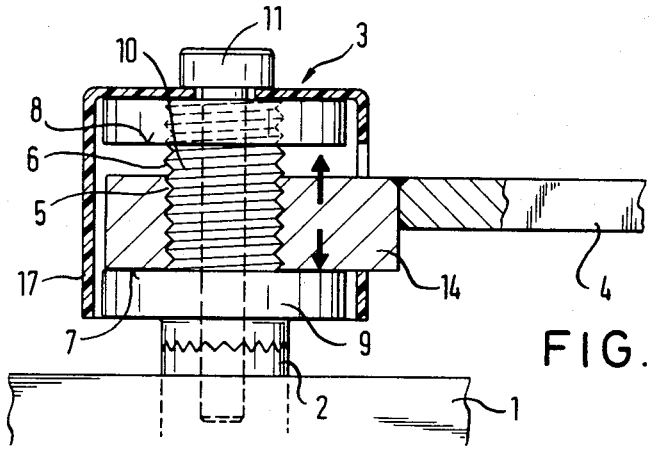
Figure 3:
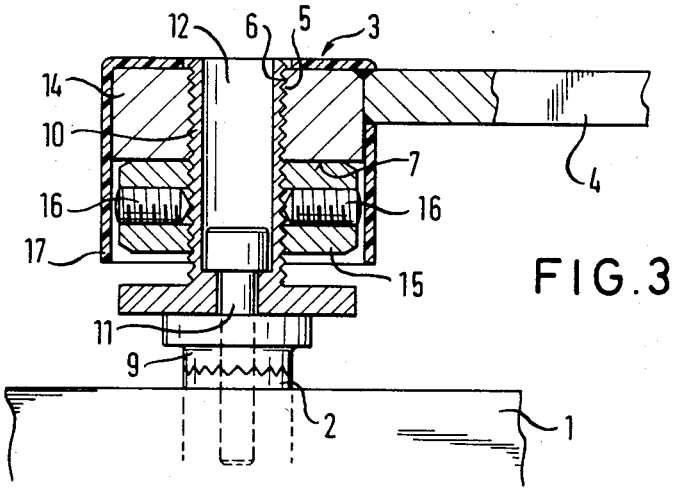

The invention will now be described in more detail in the following with reference to embodiments; the drawings show:

FIG. 1 a schematic illustration of a first variant of a door closing apparatus in accordance with the invention, wherein the unit for generating the closing force, the closer containing the fixing or blocking device and also the lever means are only illustrated in part, FIG. 2 a likewise schematically illustrated embodiment which is suitable for both right and left hand abutment of the door, and FIG. 3 a schematic illustration of a further embodiment with an adjustable, friction locking abutment.

FIG. 1 shows in schematic form the housing of a known door closing unit or closer 1 the drive axle 2 of which is provided with a toothed end face and is accessible from the outside.

An actuating lever 4 forming part of the lever means is connected with this drive axle 2 via a releasable clutch 3. In detail, a connecting part 9, which has a toothed end face corresponding to that of the drive axle 2 and a hub part 10 at its side remote from the toothed end face, is rotationally fixedly connected with the drive axle 2 by means of a securing screw 11.

The hub part 10 has an external thread 6 which cooperates with an internal thread 5 which is formed in a head part 14 of the lever 4.

The securing screw 11 is accessible via an opening 12 in the head part 14.

The connecting part 9 is provided in the region of the transition to the hub part 10 with a ring-like friction locking abutment 7 which cooperates with a corresponding ring surface of the head part 14 of the lever 4. An adjusting disc 13 is preferably arranged between the head part 14 and the friction locking abutment 7, with the adjusting disc making an accurate angular adjustment possible between the drive axle 2 and the lever 4, and thus likewise also permitting the selection of a defined bias in the region between two tooth positions of the toothed end face arrangement. The fine angular adjustment can be effected by selecting adjusting discs 13 of different thicknesses.

When the actuating lever 4 is connected with the drive axle 2 of the closer 1, via the described releasable clutch 13, and on opening a door for the first time from the closed position, the actuating lever moves the drive axle 2 of the closer 1 via the frictional coupling between the head part 14 and the frictionally engaged abutment. In this way the actuating lever energises the unit for generating a closing force which is provided in the closer. If the desired opening angle of the door is reached then the blocking arrangement provided in the closer holds the door at this angle of opening, and indeed via the intermediary of the frictional coupling (clutch) between the abutment 7 and head part 14. The blocking device is shown in the drawings, FIG. 1, in the form of a box, it can however take the form of an electromagnetically actuatable valve provided to trap a volume of hydraulic fluid in the damper cylinder conventionally provided in the closer unit. Such valves are themselves known per se and generate a holding force which can be overridden by pushing hard on the door and thereby generating a high pressure in the damper cylinder which unseats the valve. If a force is then exerted on the door in the closing direction which exceeds the retaining force of the frictional coupling between the abutment 7 on the head part 14 then the door closer remains in its position (because the force required to override the blocking device has not been reached) however the door moves, by release of the frictional coupling, into a freely pivotable state in which it is not affected by any retaining or bias force. In this state the head part 14 can move up and down the threaded connection 5, 6 but this does not impair the friction of the overall arrangement in any way.

If the door, which is now freely pivotable between the closed position and the maximum opening position predetermined by the first opening procedure, is again opened to this maximum opening angle then the frictional coupling between the friction locking abutment 7 and the head part 14 once again enters into operation and in this manner the door can be held in the maximum opening position, despite its otherwise free pivotability which is desired in many cases.

If the blocking device which blocks the drive axle 2 of the door at a specific opening angle is released, and indeed in particular by specified control signals, then the control axle 2 and thus also the hub part 10 rotate in the closing direction, whereby a frictional coupling is necessarily once again reestablished between the friction locking abutment 7 and the head part 14, as a result of the threaded connection between the hub part 10 and head part 14, and the actuating lever 4 is thus moved with the drive axle, and the door in question reliably guided into the closed position.

The variant of FIG. 2 is distinguished from the above described arrangement of FIG. 1 essentially in that this arrangement can be used without any form of conversion both for left hand and for right hand abutment because in this arrangement a further friction locking abutment 8 is provided in addition to the friction locking abutment 7, with the further friction locking abutment 8 being spaced from the friction locking abutment 7 by a distance which is larger than the maximum stroke (vertical movement) of the head part 14.

This additional friction locking abutment 8 can consist of a part threaded onto the hub part 10 and having ring-like end faces which is fixed and secured in a predetermined positiion. The head part 14 of the actuating lever is located between the two friction locking abutments 7, 8. For left hand use the friction locking abutment 8 may, for example, cooperate with the associated counter-surface of the head part 14, and for right hand use the friction locking abutment 7 may cooperate with the respectively associated counter-surface of the head part 14. In this embodiment adjusting discs can also be used as in the case of the embodiment of FIG. 1.

The entire releasable clutch 3 is provided with a plastic cover cap 17 which, in its lower region, terminates flush with the connection part 9 and provides the overall arrangement with a compact closed appearance, which in the embodiment of FIG. 1 is already achieved by the approximately pot-like form of the head part 14.

The variant of FIG. 3 has as a particular feature an adjustable friction locking abutment 7. This friction locking abutment 7 is formed by a ring-like end face of an adjustable nut 15 which is threaded onto the hub part 10 and can be locked in defined positions by means of locking screws. By using a friction locking abutment of this kind the relative position between the actuating lever 4 and the drive axle 2 at which the friction clutch engages can be accurately predetermined independently of the toothed end face connection arrangement. In this embodiment two mutually spaced friction locking abutments can also be used in principle in the sense of the embodiment of FIG. 2.

All variants have in common an extremely compact construction, high operational reliability and also the essential advantage that mounting, and in particular retrospective mounting on known closers, is possible without difficulties so that the desired release function can be realised in the simplest manner.

We claim:

1. A door holder-closer having a control signal operated hold-open function and a mechanical override facility, said door holder-closer being adapted to hold a door in any desired open position to which it is moved from a closed position and comprising a housing for mounting on one of a door and fixed structure adjacent thereto; a unit for generating a closing force contained in said housing; a drive axle extending from said unit out of said housing; lever means connectable between said drive axle and the other one of said door and said fixed structure; a mechanically overridable clutch disposed between said lever means and said drive axle for transmitting torque from said lever means to said drive axle to rotate the same on opening of said door, whereby to energize said unit; and a blocking device for blocking said unit to generate a holding force and prevent said unit from moving said door in the door closing direction, said blocking device being capable of being switched in and out by control signals; wherein said overridable clutch between said lever means and said drive axle comprises first and second interengaging threaded elements, a first abutment provided on said first threaded element, a second abutment provided on said second threaded element and confronting said first abutment, wherein, in said open position of said door, said confronting first and second abutments are in frictional engagement with one another, thus generating a frictional locking force and frictionally locking said lever means to said drive axle; wherein said threaded elements are handed so that manual forced closing movement of said door from a said open position to said closed position overcomes said frictional engagement without overcoming said holding force and thus produces relative rotation of said first and second threaded elements and separation of said confronting first and second abutments, thus permitting manual relative rotation between said drive axle and said lever means to thereby manually move the door toward said closed position, and wherein said frictional locking force is less than said holding force.

2. Apparatus in accordance with claim 1, wherein a threaded connection is formed by an internal thread provided on a head part of the lever means adjacent said drive axle and an external thread on a hub part which is rotationally fixedly connected to said drive axle.

3. Apparatus in accordance with claim 2, wherein said hub part is formed on a connecting part having a toothed end face and is rotationally fixedly connected with a correspondingly toothed end face of the drive axle by means of an axially extending securing screw.

4. Apparatus in accordance with claim 3, wherein said first and second abutments comprise a ring surface provided on said connecting part and a cooperating surface on said head part.

5. Apparatus in accordance with claim 4, wherein said abutments further comprise at least one adjustment disc arranged between said ring surface and said cooperating surface.

6. Apparatus in accordance with claim 2, wherein said first and second abutments comprise an annular end surface of an adjustment nut which is threaded onto said hub part and which can be locked in a predeterminable position relative thereto, and a cooperating surface on said head part.

7. Apparatus in accordance with claim 2, wherein a plastic cover cap extends at least to a connecting part mounted on the head part of the lever means.

8. Apparatus in accordance with claim 1 wherein said first and second friction locking abutments are provided for left and right hand assembly, and wherein the mutual spacing between said friction locking abutments is at least somewhat larger than the length of the threaded connection of said elements required for a predeterminable angular range of relative rotation between the lever means and drive axle.

* * * * *